United States Patent [19]

Thévenin et al.

[11] Patent Number: 4,619,440

[45] Date of Patent: Oct. 28, 1986

[54] FENCING DEVICE, A STAKE, A FASTENER AND AN ASSEMBLY PART FOR SUCH A DEVICE

[76] Inventors: Patrick D. Thévenin; Bernard C. Gissinger; Stéphane J. Thévenin, all of 08800, Monthermé , France

[21] Appl. No.: 575,883

[22] Filed: Feb. 1, 1984

[30] Foreign Application Priority Data

Feb. 2, 1983 [FR] France ..... 83 01608

[51] Int. Cl.[4] ..... E04H 17/00

[52] U.S. Cl. ..... 256/47; 256/54; 256/57; 256/DIG. 3; 256/DIG. 5; 403/397

[58] Field of Search ..... 256/47, 48, 54, 57, 256/58, DIG. 3, DIG. 5; 248/303, 302; 16/87.2, 87.4 R; 403/397

[56] References Cited

U.S. PATENT DOCUMENTS

| | | | |
|---|---|---|---|
| 196,175 | 10/1877 | Willcuts | 256/48 |
| 752,854 | 2/1904 | Odell | 256/48 |
| 866,478 | 9/1907 | Kerner | 256/57 |
| 867,037 | 9/1907 | Hargis | 256/57 |
| 1,109,020 | 9/1914 | Skiff et al. | 256/48 X |
| 1,214,749 | 2/1914 | Bruflat | 256/48 |
| 1,517,119 | 5/1921 | Lahring | 256/57 |
| 2,631,804 | 3/1953 | Uhlhorn | 256/47 X |
| 2,930,072 | 3/1960 | Light | 16/87.2 |
| 3,758,062 | 9/1973 | Caldwell et al. | 256/57 |

FOREIGN PATENT DOCUMENTS

| | | | |
|---|---|---|---|
| 699679 | 2/1931 | France | 256/57 |

*Primary Examiner*—Cornelius J. Husar
*Assistant Examiner*—Todd G. Williams
*Attorney, Agent, or Firm*—Darby & Darby

[57] ABSTRACT

A wire fence has a hollow elongated stake for supporting a horizontal wire. The stake has vertical rows of perforations for receiving wire fasteners. The perforations are positioned between two vertical planes tangent to vertical extending edges of the stake, the planes being parallel to the wire. The fastener has a loop for insertion into the perforation, a wire support section extending outwardly through the vertical planes, and a free end at the end of the wire support section, which is bent back toward the loop portion so that the wire is held in place.

12 Claims, 23 Drawing Figures

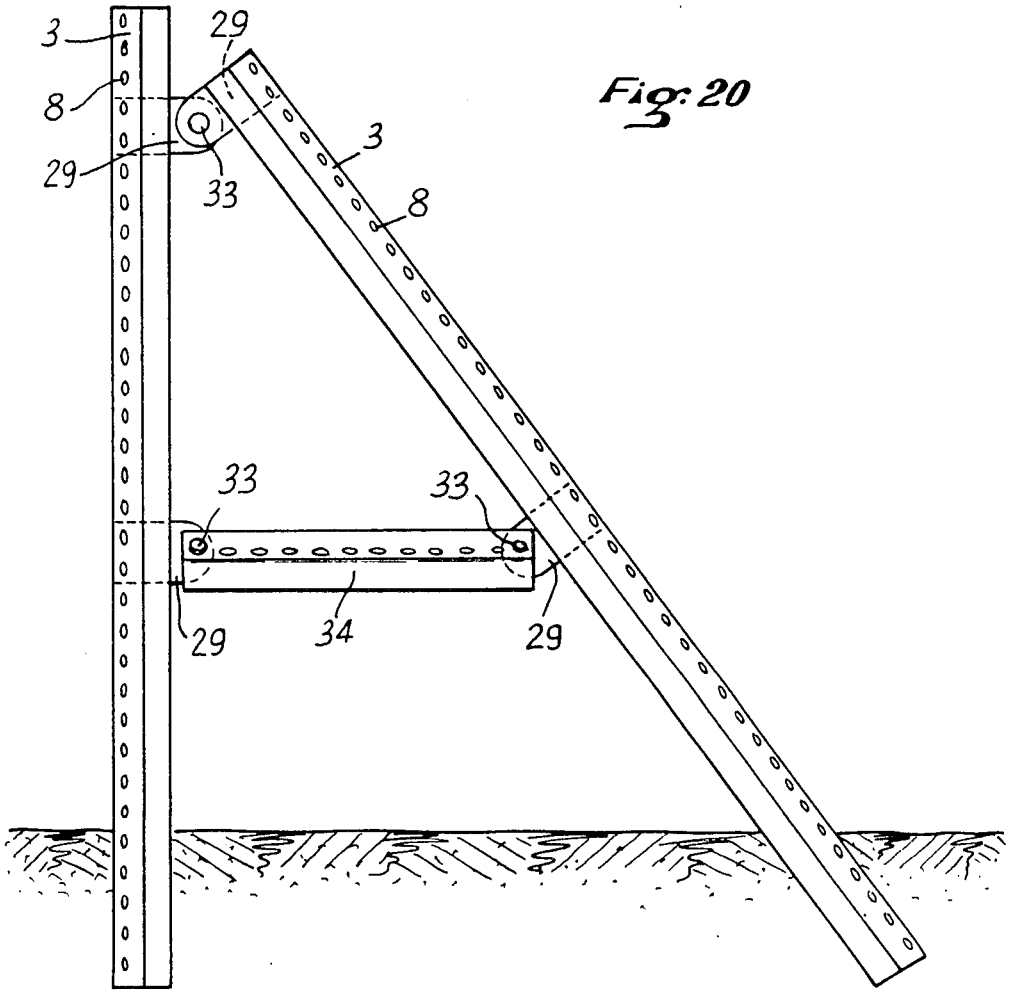
Fig. 20
Fig. 22
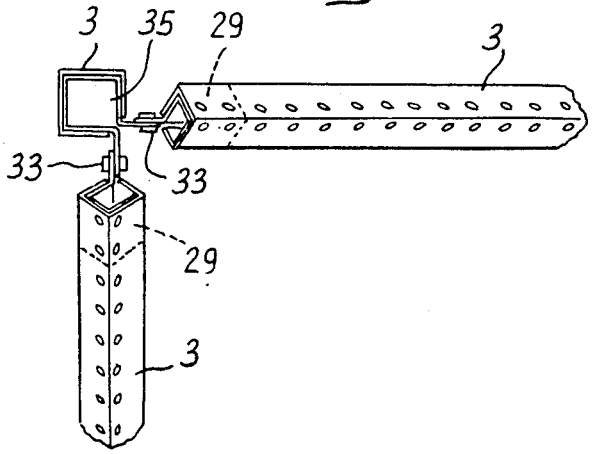

FENCING DEVICE, A STAKE, A FASTENER AND AN ASSEMBLY PART FOR SUCH A DEVICE

FIELD OF THE INVENTION

The present invention relates to the field of tying or fencing, from stakes driven into the ground, supporting one or several wires.

For such applications, the stakes have to fulfill a double function of supporting wires and of maintaining wires under tension for the end stakes. Hence, they have to be adapted to resist stresses, often considerable, in the two perpendicular directions, that is:

parallel to the tying direction for the end stakes due to the tension they support;

perpendicularly to the direction of the wires for the intermediate stakes (in the case of a wind perpendicular to the rows of vine or animals rubbing themselves against the fences).

Moreover, it is desirable that the stakes meet the five following requirements:

They have to allow the unwinding of the wire along the fence prior to fixing it to the desired end, so as to provide a quick placing in position, which is not the case if the wire has, for example, to be threaded into a hole. This requirement is particularly experienced in the case of vineyards, requiring considerable lengths of wire. Indeed and as a function of the spacing between rows, there can be from 4 to 7 kilometers of wire per hectare (10,000 square meters).

Secondly, the stake should not present sharp edges at the points of contact with the wire, or else there would be a premature wear of the wire and, with time, its breaking.

Thirdly, the wire has to be easy to be put in place at the required height when unstretched, but once under tension, it must not come out from its support and disengage itself, which is often the case in shallow or dished regions, the wire being subjected to a force directed upwardly (FIG. 1).

Fourthly, in the case of vines, the lifting wires have to be unstressed and disengaged from their fasteners in order to be repositioned in height as the vegetation grows.

Finally, when metallic stakes are involved, they have to resist the aggression of plant protective products spread on the vines or in the fields. Therefore, treated metals which are relatively costly have to be used. In order to avoid a prohibiting price for the stakes, profiles providing the highest possible strength for a given section have to be used.

None of the fencing systems presently known meet simultaneously all these requirements.

Thus:

the holed angles (FIG. 2) do not allow unwinding the wire, have around their holes protruding edges and do not allow using lifting up wires for vine;

the notched angles (FIG. 3) have sharp edges, which do not prevent the disengagement of the stretched wires when the ground is concave, and have a reduced mechanical strength due to these notches;

the angles with attached bar (FIG. 4) have sharp edges, which do not allow an easy handling of the lifting wires and require an extra device for the fixation of the bars, making the system more costly;

the notched sections, such as those shown in FIGS. 5 and 6, have sharp edges, do not eliminate completely the risk of disengagement of the stretched wire out of the notches where the ground has a concave profile and offer a reduced mechanical strength due to the notches;

nor the perforated profiles with fasteners, such as those shown in FIG. 7 are satisfactory. Indeed, the perforations are disposed on the edges perpendicular to the wires and therefore weaken the stake, and their sharp edges cause wear to the wires. Moreover, the fastener does not allow disengagement of the wire for lifting up operations, while fastener b does not avoid the risk for the wire to disengage from the fastener when the ground is undulated.

OBJECTS AND SUMMARY OF THE INVENTION

The fencing or tying system according to the invention provides an assembly of stakes and fasteners meeting simultaneously the five hereabove requirements.

To this effect, the invention relates to a fencing or tying device using wires, stakes and fasteners allowing fixing the wires to the stakes, in which:

the stake is a hollow profile, closed or not, formed at least with two perforations for the fixation of a fastener, said perforations being disposed between two tangential vertical planes containing the stake and parallel to the fencing or tying plane;

the fastener comprises a first portion in the shape of a loop for its fixation into two perforations of the stake, to this loop-shaped portion is connected a horizontal supporting portion for a fencing or tying wire, the length of said supporting portion being such that when the fastener is fixed to the stake, the end of said supporting portion opposite said loop-shaped portion is outside a vertical plane tangent the edge of the stake and parallel to the fencing or tying plane on the side of said fastener, and a portion forming a lock for the fencing or tying wire being connected to this supporting portion, lifted obliquely and upwardly in the direction of the median plane of the stake parallel to the aforementioned tangential plane and the free end of which is between said median and tangential planes.

The stake can be of circular, ellipsoidal section, or of polygonal shape.

When the stake has an opened profile, the perforations or perforation lines are disposed substantially in the portion of the profile which is opposite its opening.

According to a preferred embodiment, a stake comprises two parallel perforation lines disposed in the vicinity of each other, on either side of a median vertical plane of the stake parallel to the fencing or tying plane.

According to another preferred embodiment, the stake is a hollow square sectioned profile, opened at the location of one of its edges, the three other edges of which are rounded and comprises two vertical perforation lines disposed on either side of the edge opposite the profile opening.

Such a profile authorizes a continuous fabrication; the arrangement of the perforations provides an optimnm value of the inertia moment, thereby allowing using lighter profiles for a strength comparable to that of the usual profiles. The use of opened profiles is also the source of savings of material.

The invention relates also to assembly parts for the realization of the end posts from two hereabove stakes and/or for the adaptation of struts on one of said stakes.

The invention relates also to a hook specially provided for cooperating with the stake for the hooking up of the end small chains of the lifting up wires and for the anchoring of the fastening wires and of the streching wires.

Further features and advantages of the invention will become apparent from the following description of a non limiting embodiment.

BRIEF DESCRIPTION OF DRAWINGS

This description refers to the accompanying drawings wherein:

FIG. 20 is a profile view of a stake provided with a strut assembled with the assistance of the part of FIG. 19.

FIG. 22 is a plan view of the mounting on a stake of two struts disposed perpendicularly by means of the parts of FIGS. 19 and 21.

DETAILED DESCRIPTION OF THE EMBODIMENTS

Figure 1:
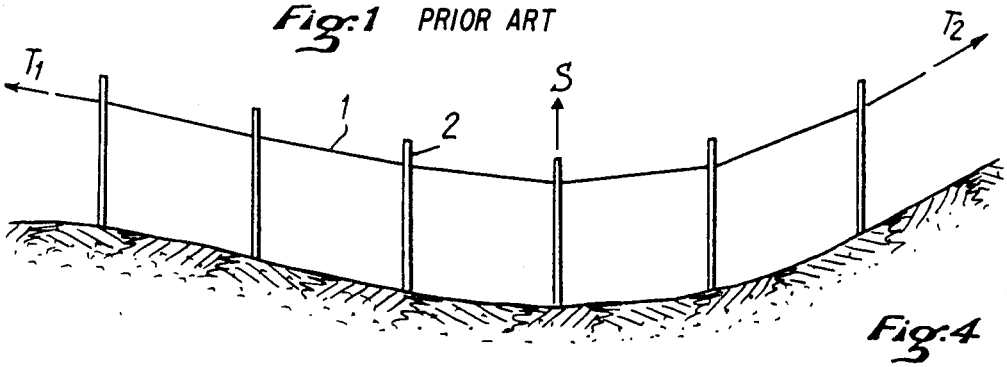
Fig. 1 PRIOR ART
FIG. 1 shows schematically that when the fencing or tying is implanted in a convex ground, the tension of the wire in directions $T_1$ and $T_2$ produces a lifting force S tending to disengaging wire 1 from its fasteners on stakes 2.
Figure 2:
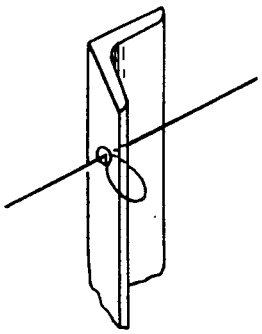
Fig. 2 PRIOR ART
FIGS. 2 through 7 show various fencing or tying systems presently know.
Figure 3:
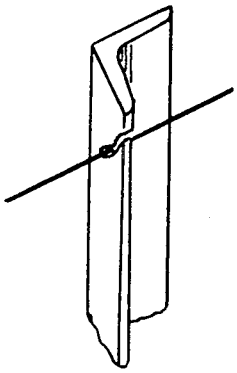
Fig. 3 PRIOR ART
Figure 4:
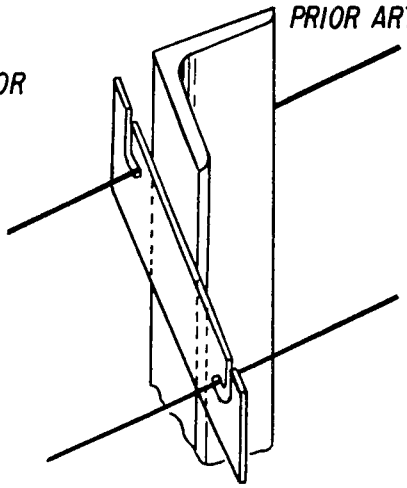
Fig. 4 PRIOR ART
Figure 5:
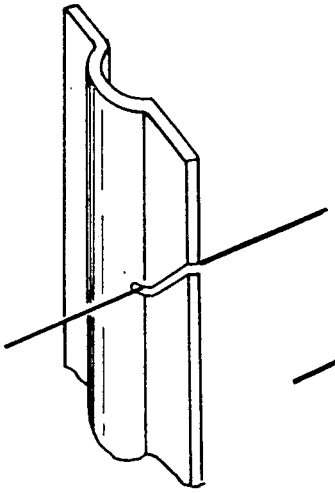
Fig. 5 PRIOR ART
Figure 6:
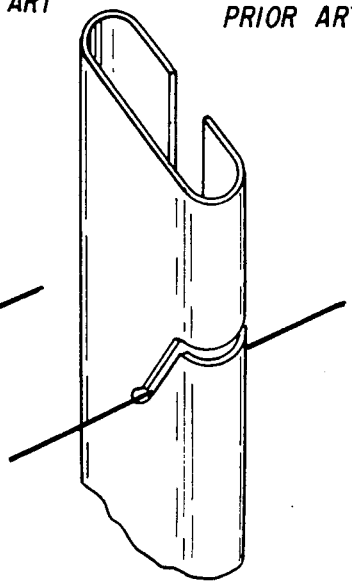
Fig. 6 PRIOR ART
Figure 7:
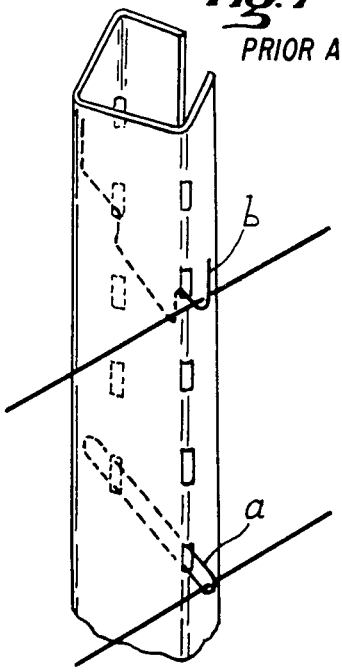
Fig. 7 PRIOR ART
Figure 8:
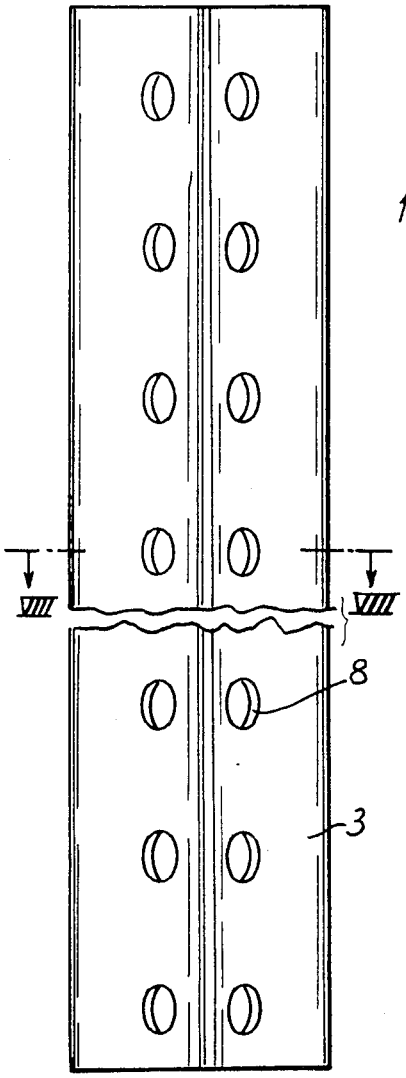
FIG. 8 is a frontal view of a portion of the stake according to the invention, when looking in the direction of the perforation lines.
Figure 9:
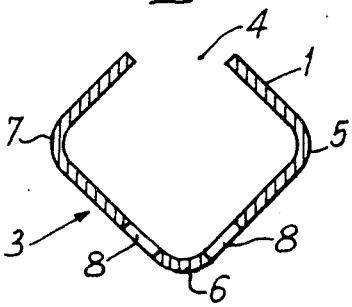
FIG. 9 is a horizontal sectional view along line VIII—VIII of FIG. 8.

The stake portion shown in FIGS. 8 and 9 is made of an opened hollow profile 3, of substantially square shape.

The opening 4 is situated at the location of one of the edges of the square.

The three other edges 5, 6 and 7 are rounded.

On either side of edge 6 opposite opening 4 are formed two perforation lines 8, extending vertically on the whole height of stake 3.

Figure 10:
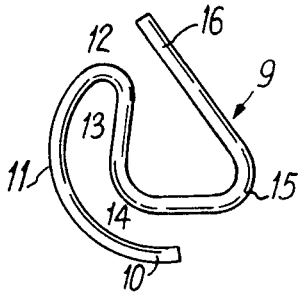
FIG. 10 is a plan view of a fastener according to the invention.

The fastener 9, used for cooperating with stake 3, is shown in FIG. 10. It is made advantageously of a spring steel wire folded such as to comprise three portions operatively connected to each other, viz.:

A first fixation portion, loop-shaped, extending from point 10 to point 14 of FIG. 10.

A horizontal support portion of the wire is connected to the loope-shaped portion. It extends from 14 to 15 in FIG. 10.

It is elongated by a lock forming portion extending from 15 to 16, extending obliquely from point 15 in the direction of the upper point 12 of the loop-shaped portion.

The curvature of the loop-shaped portion is such that its free end 10 extends over a certain distance, parallel to the support forming portion and below the latter.

The free end 16 of the lock forming portion is protruding above the upper point 12 of the loop.

Figure 11:
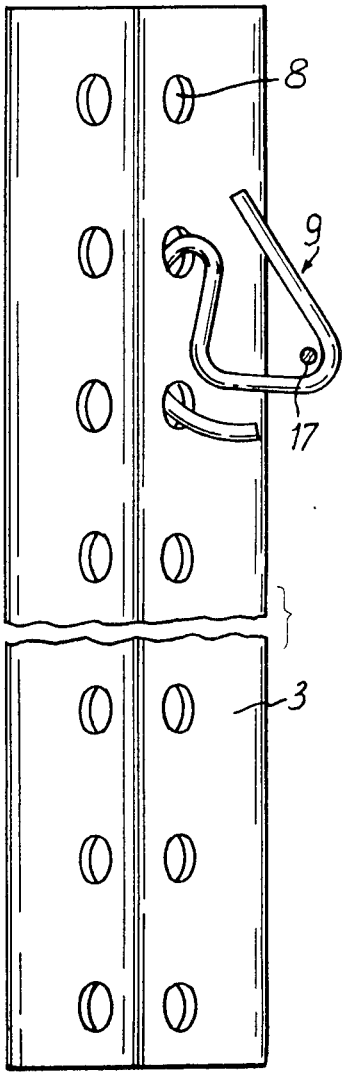
FIG. 11 is a view similar to that of FIG. 8, the fastener of FIG. 10 being but in position on the stake.

In order to put fastener 9 in place on stake 3, as shown in FIG. 11, its end 10 is introduced into a hole 8, at the desired height, said end 10 being thus inside of stake 3. By a rotation movement, said end 10 is forced to move down toward hole 8, immediately below, through which it extends outside the stake. The fastener 9 being preferably made of spring steel wire recovers its initial shape due to its resiliency.

As an alternative, when using for the fastener a non resilient material, the loop is given a shape allowing its introduction by rotation into two successive holes of the profile, then the free end of the loop of the elbow 14 is closed, for example by means of plyers, thereby locking the fastener.

Wire 17, once stretched, is housed inside the connection bend 15, between the support portion and the lock forming portion.

As shown more particularly in FIGS. 11, 12, 13 and 14, the end 15 of the support forming portion of fastener 9 is outside a vertical plane tangent the stake edge 5, 7, said plane being parallel to the tying plane. The lock forming portion is extending obliquely and upwardly in the direction of the median vertical plane 18 of the stake, which is parallel to the aforementioned tangential plane, and its free end 16 is between said tangential and median planes.

In this way, when wire 17 is stretched, it cannot disengage from a fastener 9 under the effect of forces directed upwardly, whereas when unstretched, it can be easily removed from the fastener, for example for lifting up operations.

Figure 12:
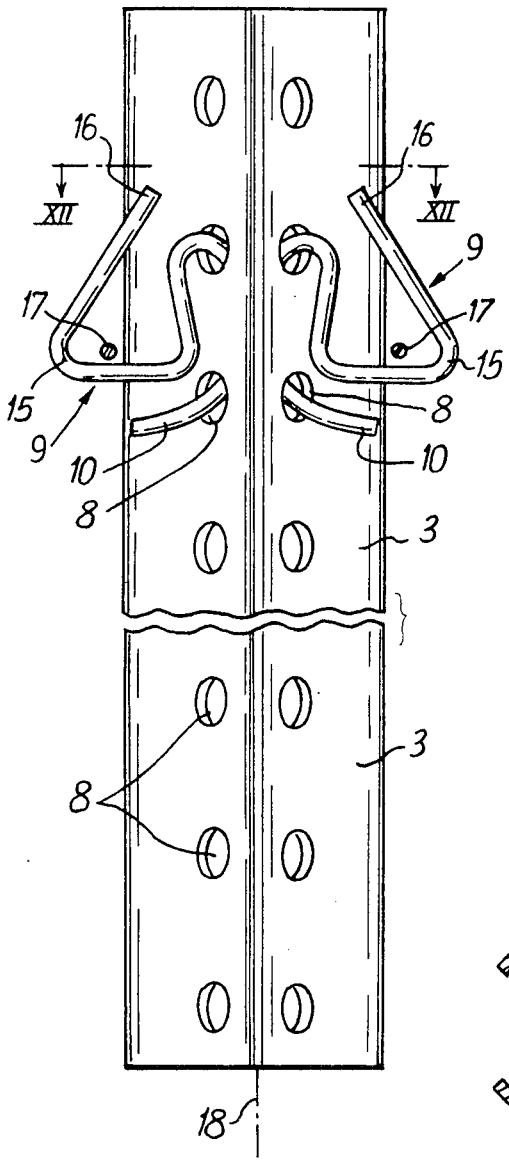
FIG. 12 s a view similar to that of FIG. 8, two fasteners according to FIG. 10 being in place for threading two wires on either side of the stake.
Figure 13:
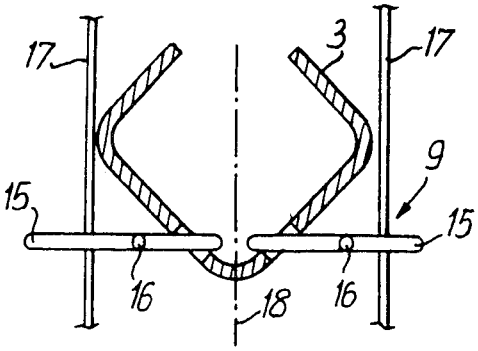
FIG. 13 is a horizontal sectional view along line XII—XII of FIG. 12.
Figure 14:
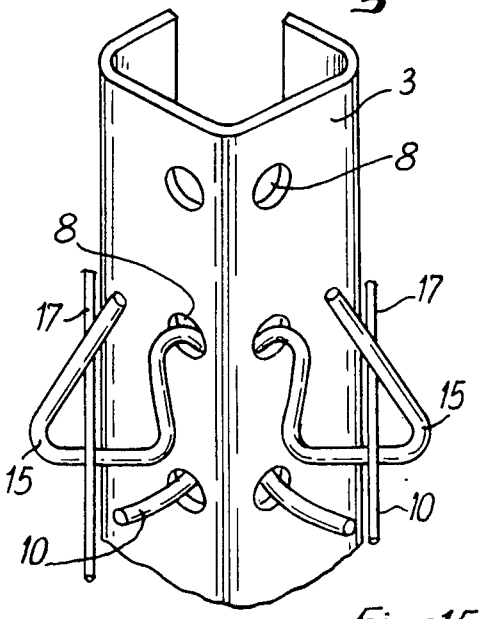
FIG. 14 is a perspective view of a stake according to FIGS. 12 and 13.

As shown in FIGS. 12 and 13, the disposition of the two perforation lines on either side of edge 6 of stake 3 authorizes the placing of the wires on either side of the stake.

This disposition of the perforations authorizes on the other hand a combination of several stakes together for forming end posts of high strength.

As a function of the required strength for the end post, such post can be provided by combining two, three or four stakes.

Figure 15:
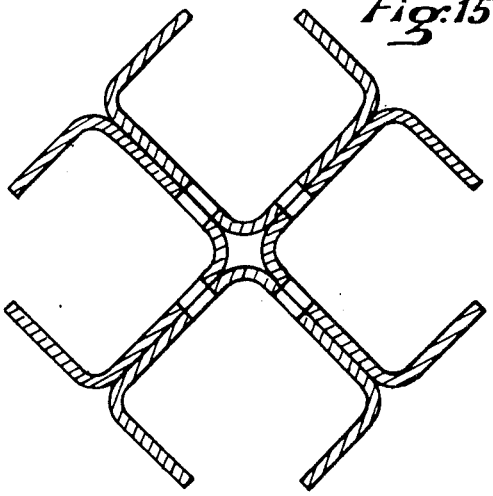
FIG. 15 shows an example of an assembly of stakes according to FIG. 8 for forming end posts.

FIG. 15 shows an example of the disposition of four stakes assembled such that their perforations are in register and rigidly connected by bolts passing throughsaid perforations.

Figure 16:
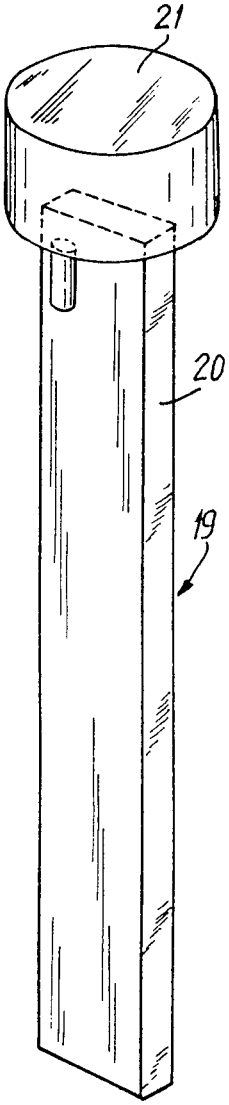
FIG. 16 is a perspective view of a tool specially designed for the installation of stakes according to FIG. 8.

FIG. 16 shows a tool 19, specially designed for the installation of stakes 3, according to the invention. This tool comprised a flat body 20, of a thickness allowing it to be introduced through opening 4 of stake 3 and having a width substantially equal to the diameter of said post.

On said flat surface 20 is fixed a head 21.

The flat surface 20 provides a guide for driving in the stake while preventing its buckling, while head 21 which receives the impacts from the sledge causes a better distribution of the forces on the periphery of the stake and prevents its deterioration.

The end posts such as that shown in FIG. 15 are adapted for supporting considerable forces. However, they are difficult to put correctly in place, since their resistance to the penetration in the ground is high.

Figure 17:
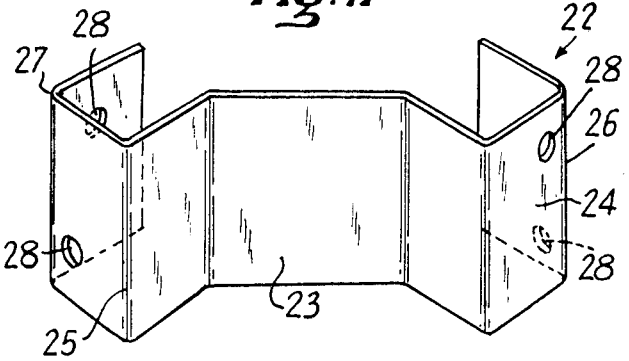
FIG. 17 is a perspective view of a bracing part for forming an end post with two stakes.
Figure 18:
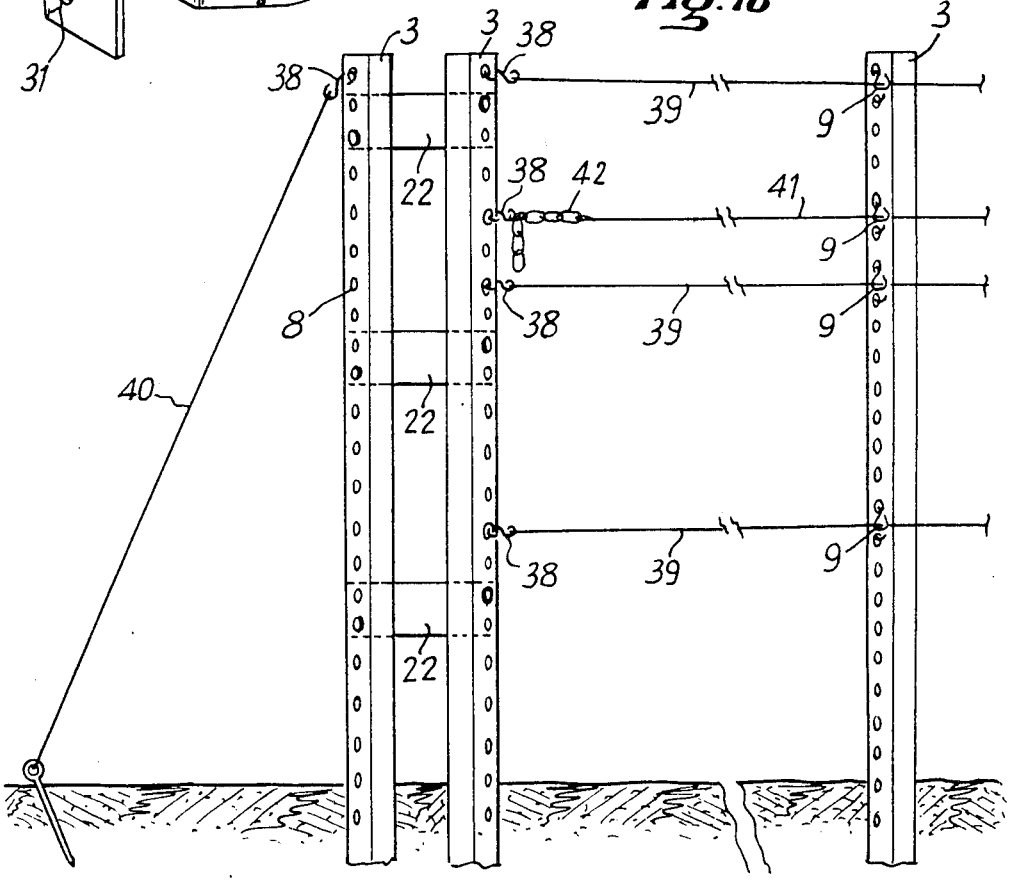
FIG. 18 is a profile view of the end of a tying line comprising a post made of two assembled stakes with the bracing part of FIG. 17.

FIGS. 17 and 18 show an advantageous embodiment of a simplified post made of two stakes, the performance of which is similar to that of a post made of four stakes and the installation of which is much easier.

To this effect, one uses according to the invention at least one and preferably several bracing parts 22 for rigidly connecting two stakes 3 opposed to each other by an opened edge 4.

The bracing part 22 is a profile formed from a bent plate and comprising a web 23, possibly ridged, two portions 24, 25 having a shape corresponding to that of stake 3 but of slightly different size, being connected on either side, so that they can be slided outside or inside a stake.

Portions 24 and 25 are formed with at least two perforations 28, threaded or not, for cooperating with the perforations 8 of a stake 3 for the fixation of the assembly by appropriate means such as screws or bolts.

In the example shown, the shape of portions 24 and 25 of the bracing part 22 is a U-shape, the wings of which are folded substantially at a right angle relative to the bottom.

Two perforations 28, preferably threaded, are disposed on either side of the outer edge 26, 27 of said U-shaped portions 24 and 25, according to two planes spaced vertically from each other by a distance equal to the pitch of perforations 8 of a stake 3.

The U-shaped portions 24 and 25 are disposed symmetrically on either side of web 23 and their connecting face forms with the plane of said web 23 an angle of 135°.

As shown in FIG. 18, the two stakes 3 to be assembled are presented with their opened edges turned toward each other and the U-shaped portions 24 and 25 of the bracing part 22 are slided inside of each stake up to the desired level, the assembly being then fixed by bolts passing through the perforations 8 of stakes 3 and 28 of the U-shaped portions 24 and 25. Preferably, the perforations 28 are threaded holes, allowing omitting the nuts.

The assembly thus formed provides a very resistant beam able to support very important flexural efforts.

The number of bracing parts 22 to be used depends on the height of the post and on the effort to which it is subjected. Generally, a spacing of 50 centimeters is sufficient.

Preferably, the installation of such an end post is carried out according to following operating mode allowing driving in only a single stake at a time.

The number of bracing parts required is fixed on a stake 3, at the desired locations, with the assistance of screws or bolts. Then, said stake 3 is driven in to its final position in the ground with the aid of tool 19. A second stake 3 is then threaded onto portions 24 and 25 left free of bracing parts 22, the assembly already installed acting as a guide for the installing of a second stake, the latter being driven in the same manner as previously and then fixed to the bracing parts 22 with screws or bolts.

For some applications, it can be desirable to provide stake 3 with one or two struts. This is particularly the case when stake 3 is used for a fence or tying in a closed ground in which there is no space beyond the head stake for providing the anchoring or anchorings.

Figure 21:
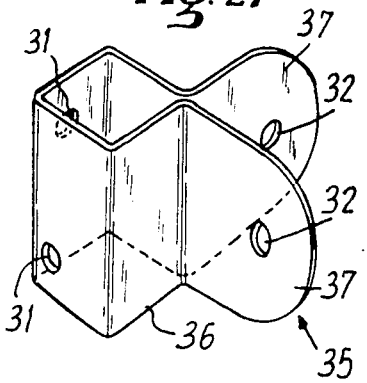
FIG. 21 is a perspective view of an assembly part for two struts disposed perpendicularly.
Figure 19:
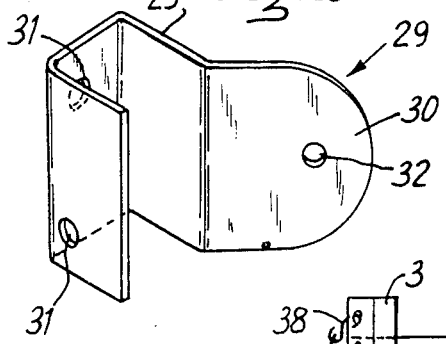
FIG. 19 is a perspective view of an assembly part for a strut.

According to the invention, this is made possible by using the special assembly parts 29 and 35 shown in FIGS. 19 and 21.

For mounting a single strut, one uses part 21 shown in FIG. 19. Said part comprises a portion 25', similar to portions 24 and 25 of bracing part 22 and provided for cooperating with stake 3, to which is connected a fixation ear 30, formed with a perforation 32. In the example shown, part 25' is U-shaped, the wings of which are bent a right angle relative to the bottom, ear 30 forming an angle of 135° with the wing to which it is connected. On either side of the edge opposite ear 30 are formed two perforations 31, preferably threaded, in two planes vertically spaced apart by a distance equal to the pitch of the perforations 8 of a stake 3.

As shown in FIG. 20, a part 29 is fixed at the upper end of a stake 3 used for forming a strut, another part 29 is fixed on a second stake 3 and the two are rigidly connected by a bolt 33 passing through the perforations of the two ears 29, after having provided the strut with the required slant.

Preferably, the assembly is made rigid by means of a transverse brace 34 mounted on two extra parts 29 fixed approprately to the stake and to the strut.

For mounting the two struts by the square on stake 3, parts 35 are used, such as those shown in FIG. 21 and parts 29.

Part 35 includes a portion 36 having a shape corresponding to that of stake 3, but of a size slightly different. To this portion are connected two fixation ears 37 diverging outwardly, forming between themselves an angle having the same value as that of the closings, and generally a square angle.

The ears 37 include, as ear 30 of part 29, a perforation 32. Portion 36 is formed with perforations 31 for cooperating with the perforations 8 of a stake.

In the example shown in FIG. 21, the portion 36 of part 35 is an opened square profile the two opened edges of which are prolongated by ears 36 diverging outwardly and forming therebetween a straight angle.

The perforations 31, preferably threaded, are disposed on either side of the edge opposite the opening of profile 36 according to two planes vertically spaced apart by a distance equal to the pitch of the perforations 18 of a stake 3.

With this part 35, it is possible, in a manner similar to that hereabove described for part 29, to mount on a stake 3 two struts disposed in perpendicular planes, as shown in a plan view in FIG. 22.

Each of the struts is made of a stake or a portion of stake 3 at the head of which is bolted an assembly part 29. Transverse braces can also be mounted by means of an extra part 35 and two other parts 29.

As previously decribed, stake 3 and its fastener 9 have been designed such as to avoid any sharp edge at the locations where the wires bear, so as to reduce the wear of the latter. For the same purpose, the invention provides for the fixation of the various wires and anchoring elements on the end stakes a hook 38 adapted to the perforations 8 of stake 3.

Figure 23:
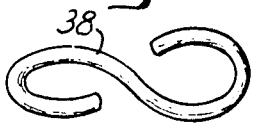
FIG. 23 is a perspective view of a special hook for cooperating with the stake.

Said hook 38, shown in FIG. 23, is made of a preferably metallic and S-shaped wire, the loops of which have a large opening. Preferably, the two loops of the hook are disposed into two different planes.

Due to its its S shape with a large opening, hook 38 allows a very easy positioning in height of the various wires being anchored to an end stake, viz. the stretching wires 39, the anchoring wires 40 and the lifting up wires 41 (FIG. 18).

Hook 38 is simply passed through two adjacent perforations 8 of stake 3, placed in the same horizontal plane, while the wires are anchored on its loop left free.

Hook 38 allows also using, together with stake 3 according to the invention, the current lifting devices, such as the small chains 42 (FIG. 18)

We claim:

1. Apparatus for constructing a fence of the type having a generally horiztonal wire, comprising:

an elongate stake for supporting the fence wire, said stake having a generally hollow cross-sectional profile, said stake further having at least two perforations, said perforations being disposed one above the other and between two vertical planes tangent to vertically extending edges of said stake, said planes being parallel to the direction of said wire; and a fastener adapted to fasten said generally horizontal wire to said stake, said fastener comprising a first portion in the shape of a loop for attaching said fastener into said stake perforations, a second horizontal portion connected at one end to an end of said first portion for supporting said wire when said fence apparatus is assembled, said second portion having a length such that a second end of said second portion opposite said first portion extends outside one of said vertical planes when said first portion is attached into said perforations of said stake, and a third portion connected to said second end of said second portion for securing said wire to said stake, said third portion having a free end bent upwardly and back toward the fastener first portion so that said free end is located between one of said vertical planes and a third vertical plane passing through the center of said stake and also parallel to said first two vertical planes, when said fastener is assembled into said perforations.

2. The fence constructing apparatus according to claim 1, wherein said stake hollow profile is open along its length, and said perforations are disposed opposite said longitudinal opening.

3. The fence constructing apparatus according to claim 2, wherein said perforations are included in two substantially parallel lines of perforations along the length of said stake, said lines being disposed opposite said longitudinal opening.

4. The fence constructing apparatus according to claim 3, wherein said stake cross-sectional profile is substantially square having four corner edges, said longitudinal opening extending along one said corner edge of said square, said three other corner edges being generally rounded.

5. The fence constructing apparatus according to claim 2, further comprising a bracing part for joining two stakes together including a web, and first said second attaching portions, said web having said first portion connected to one end and said second portion connected to the other end of said web, each of said attaching portions having cross-sectional profiles similar to that of said stake, and further having perforations therethrough, said bracing part perforations spaced so as to correspond to the spacing of said stake perforations.

6. The fence constructing apparatus according to claim 4, further comprising a bracing part for joining two stakes together, said bracing part including a web connected at it ends to two attaching portions, each of said attaching portions having cross-sectional profiles similar to that of said stake, and further having perforations therethrough, said bracing part perforations spaced so as to correspond to the spacing of said stake perforations.

7. The fence constructing apparatus according to claim 6, wherein said attaching portions are generally U-shaped including two sides each adjacent to a third side, said adjacent sides of said U-shaped portion being at approximate right angles to said third side.

8. The fence constructing apparatus according to claim 7, wherein said web is connected to a side of each U-shaped portion at an angle of approximately 135 degrees.

9. The fence constructing apparatus according to claim 4, further comprising a strut for bracing one stake to another, said strut including a strut main portion, and a strut connector portion at each end of said strut main portion, wherein said strut main portion comprises a length of stake, and a first part of said strut connector portion has a cross-sectional profile similar to that of said stake, and has perforations therethrough, spaced so as to correspond to said spaced perforations on said strut main portion stake, said strut main portion further haivng an ear portion connected to said first part of the connector portion, the ear portion having a perforation therethrough.

10. The fence connstructing apparatus according to claim 9, wherein said first part of said strut connector portion is substantially U-shaped, and said ear portion extends at an angle of approximately 135 degrees from a side of said U-shaped connector portion to which it is connected.

11. The fence constructing apparatus according to claim 4, further comprising a second assembly part for connecting two struts together, said second assembly part including a first portion having a cross-sectional shape similar to that of the said stake, and having spaced perforations therethrough corresponding to said perforations of said stake, and ear portions connected to said first portion, each ear having a perforation therethrough, said ears diverging outwardly from one another from points at which they are connected to said first portion of said second assembly part.

12. The fence constructing apparatus according to claim 11, wherein second assembly part first portion cross-sectional profile is that of a square opened along one corner edge, said ears being connected along opened edges at said opened corner.

* * * * *